US007921857B2

(12) United States Patent
Gueret

(10) Patent No.: US 7,921,857 B2
(45) Date of Patent: Apr. 12, 2011

(54) APPLICATOR FOR APPLYING A COMPOSITION TO THE EYELASHES AND/OR THE EYEBROWS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1168 days.

(21) Appl. No.: 11/438,397

(22) Filed: May 23, 2006

(65) Prior Publication Data

US 2006/0279181 A1 Dec. 14, 2006

Related U.S. Application Data

(60) Provisional application No. 60/688,363, filed on Jun. 8, 2005.

(30) Foreign Application Priority Data

May 24, 2005 (FR) ..... 05 51354

(51) Int. Cl.
*A45D 40/26* (2006.01)
*A45D 40/24* (2006.01)

(52) U.S. Cl. ..... 132/218; 132/317

(58) Field of Classification Search ..... 132/88.5, 132/88.7, 120, 138, 162, 317, 320, 901, 216, 132/218, 139, 141; 15/165, 154, 110, 212, 15/205.2, 167.1; 401/126, 129; 11/438, 11/397; 60/688, 363; 212/216
See application file for complete search history.

(56) References Cited

U.S. PATENT DOCUMENTS

| | | | | |
|---|---|---|---|---|
| 3,862,639 | A * | 1/1975 | Schefer et al. | 132/112 |
| 4,446,880 | A * | 5/1984 | Gueret et al. | 132/218 |
| 4,565,205 | A * | 1/1986 | Taylor | 132/218 |
| 4,964,429 | A * | 10/1990 | Cole | 132/218 |
| 5,007,442 | A * | 4/1991 | Hirzel | 132/218 |
| 5,123,431 | A * | 6/1992 | Wilson | 132/320 |
| 5,611,361 | A * | 3/1997 | Leone | 132/218 |
| 5,761,760 | A * | 6/1998 | Dumler et al. | 15/206 |
| 6,067,997 | A | 5/2000 | Gueret | |
| 6,408,857 | B1 | 6/2002 | Neuner | |
| 6,412,496 | B1 | 7/2002 | Gueret | |
| 6,446,637 | B2 | 9/2002 | Gueret | |
| 6,539,950 | B1 * | 4/2003 | Gueret | 132/218 |
| 6,546,937 | B2 * | 4/2003 | Gueret | 132/218 |
| 6,581,610 | B1 | 6/2003 | Gueret | |

(Continued)

FOREIGN PATENT DOCUMENTS

EP 0 875 169 A1 11/1998

(Continued)

*Primary Examiner* — Robyn Doan
*Assistant Examiner* — Brianne O'Neill
(74) *Attorney, Agent, or Firm* — Oliff & Berridge, PLC

(57) ABSTRACT

An applicator for applying a composition to eyelashes and/or eyebrows may include: a stem; and an applicator member at one end of the stem. The applicator member may include: a support that is made of plastics material, and that is elongate along a longitudinal axis. The support may be connected at a proximal end to the stem, and may include a free distal end. The support may include only two branches that extend along the longitudinal axis of the support. The branches may form a single opening therebetween, and together may define a greatest width of the support. At least one row of applicator elements may be disposed on one of the branches. The at least one row may include applicator elements which, over at least half of their length, extend other than over the opening.

63 Claims, 4 Drawing Sheets

U.S. PATENT DOCUMENTS

| | | | | |
|---|---|---|---|---|
| 6,655,390 | B2 * | 12/2003 | Gueret | 132/218 |
| 6,666,607 | B2 * | 12/2003 | Gueret | 401/130 |
| 2001/0003785 | A1 | 6/2001 | Protzmann et al. | |
| 2001/0047808 | A1 | 12/2001 | Gueret | |
| 2002/0020424 | A1 * | 2/2002 | Gueret | 132/218 |
| 2003/0089379 | A1 * | 5/2003 | Gueret | 132/218 |
| 2003/0213498 | A1 * | 11/2003 | Gueret | 132/218 |
| 2004/0035437 | A1 * | 2/2004 | Gueret | 132/218 |
| 2005/0217691 | A1 | 10/2005 | Petit | |

FOREIGN PATENT DOCUMENTS

| | | | |
|---|---|---|---|
| FR | 2 868 264 | A | 10/2005 |

* cited by examiner

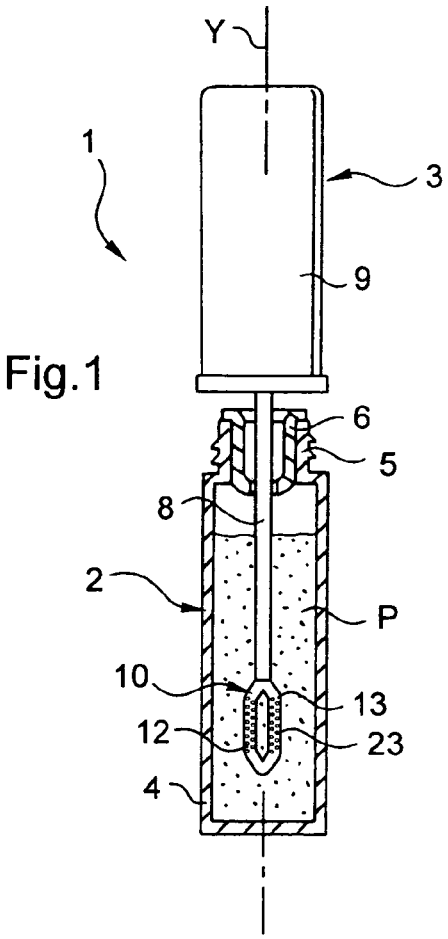
Fig.1
Fig.2
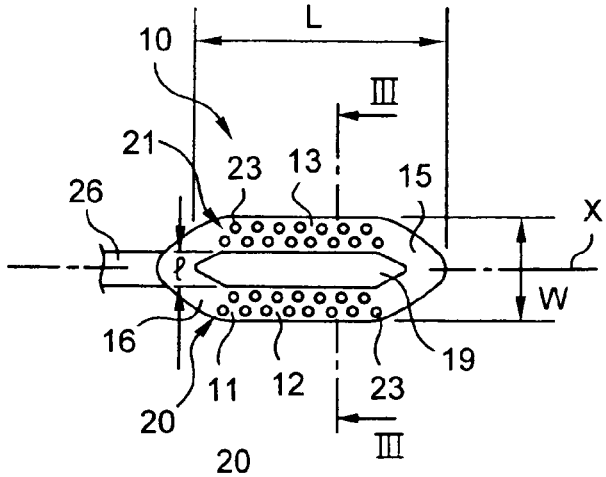
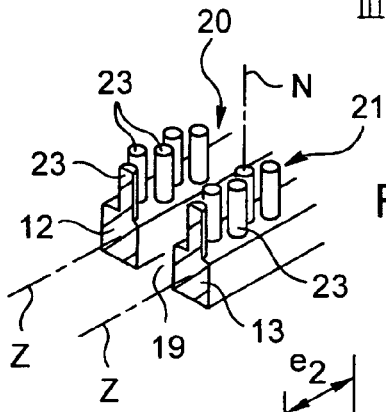
Fig.3
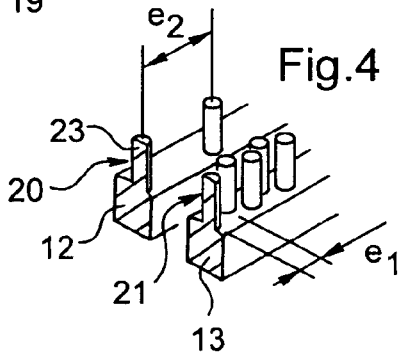
Fig.4
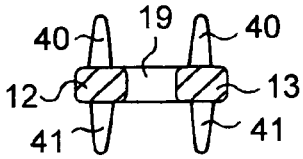
Fig.5
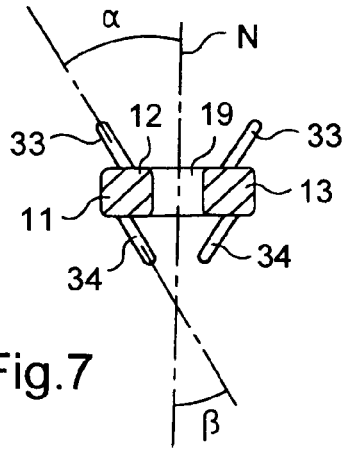
Fig.7
Fig.6
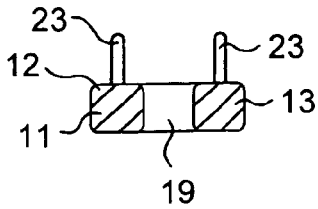

Fig.8
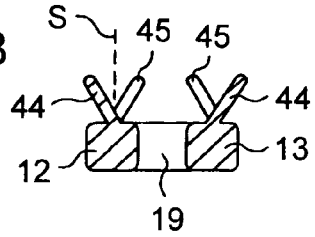
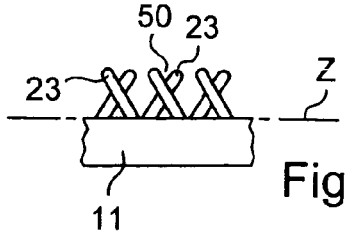
Fig.9
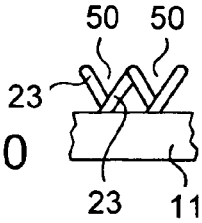
Fig.10
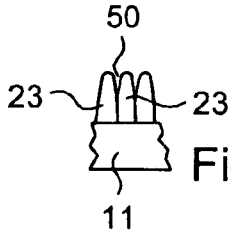
Fig.11
Fig.12
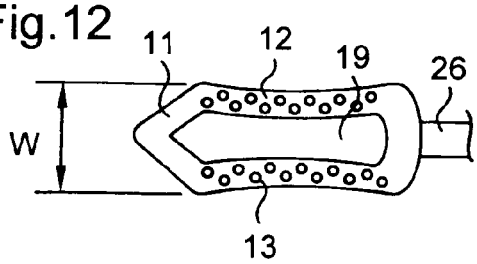
Fig.13
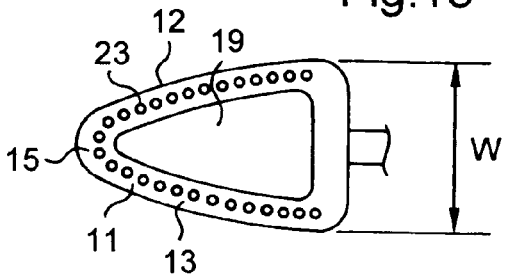
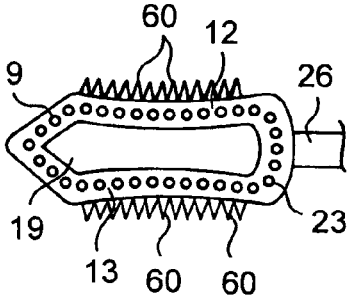
Fig.14
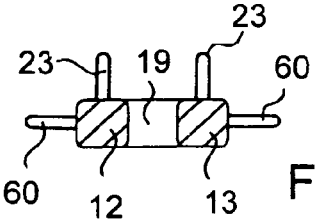
Fig.15
Fig.16
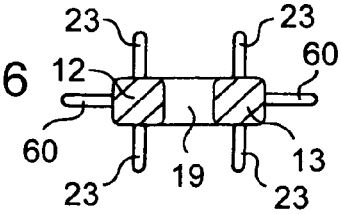
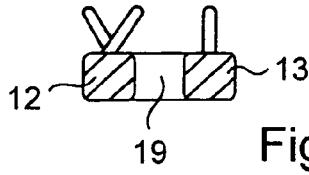
Fig.17
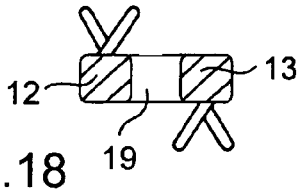
Fig.18
Fig.19
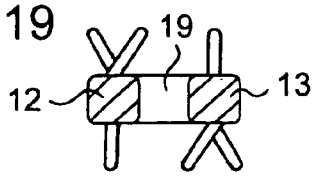

Fig.20
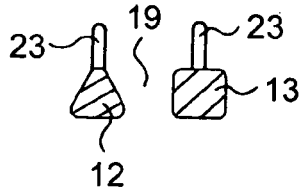
Fig.21
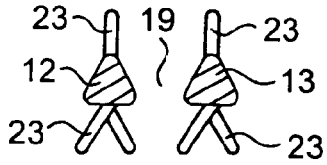
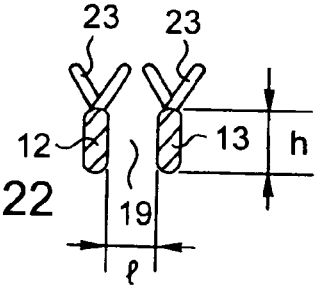
Fig.22
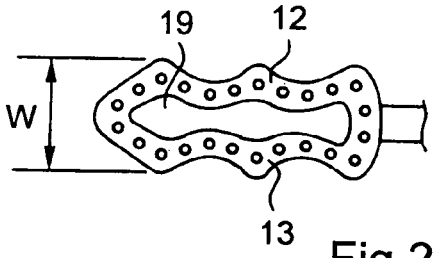
Fig.23
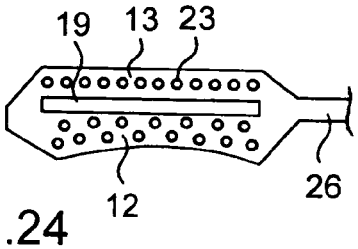
Fig.24
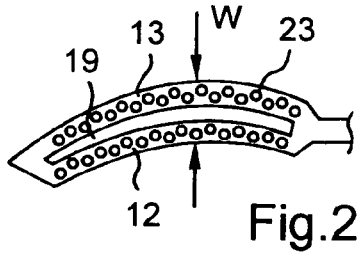
Fig.25
Fig.26
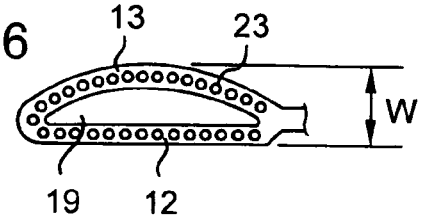
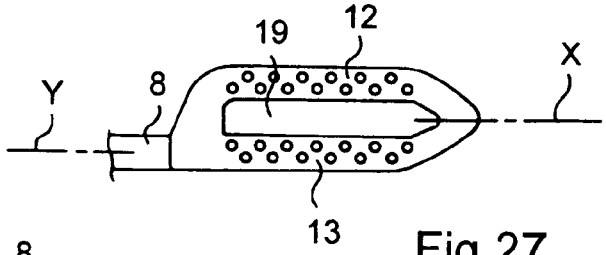
Fig.27
Fig.28
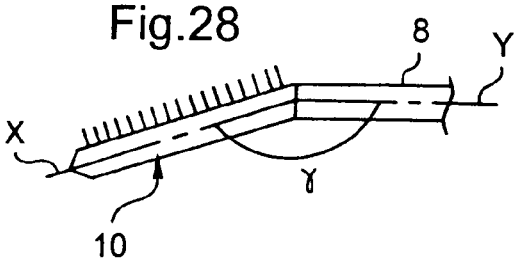

Fig.29
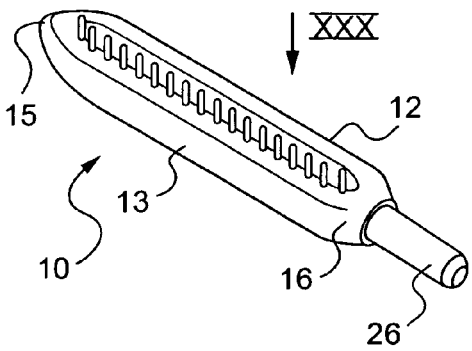
Fig.32
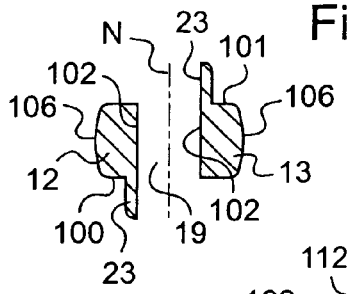
Fig.34
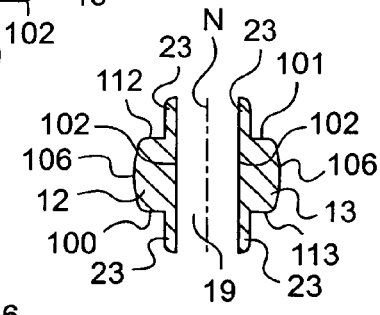
Fig.30
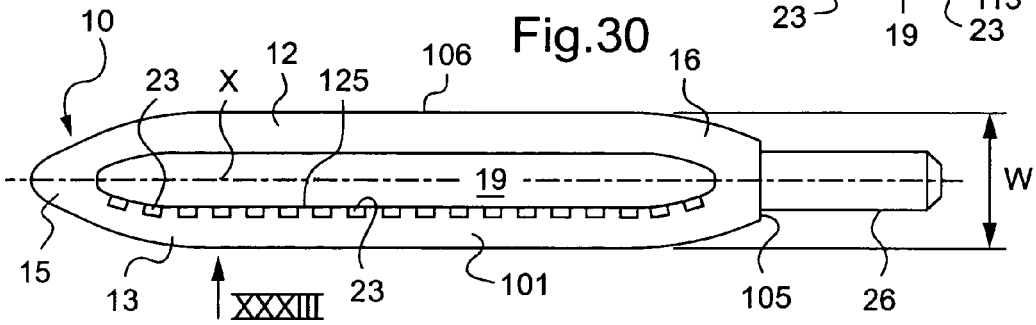
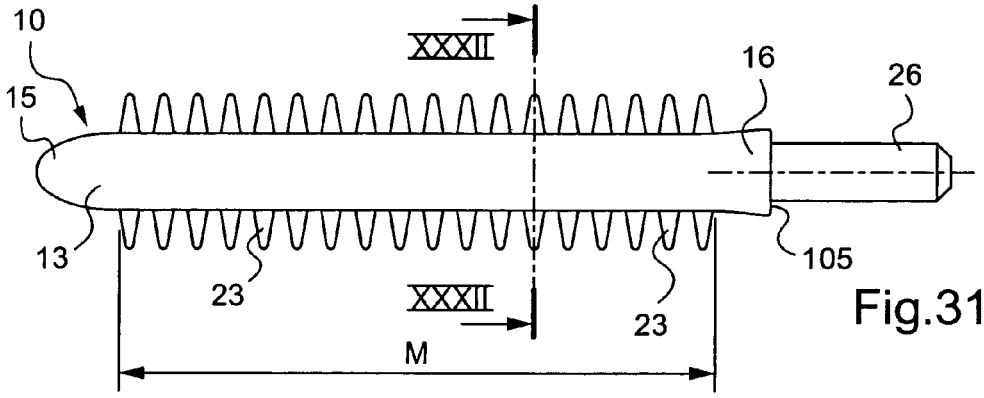
Fig.31
Fig.23
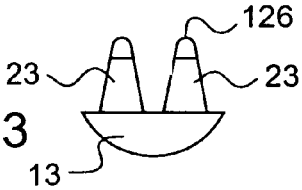
Fig.35
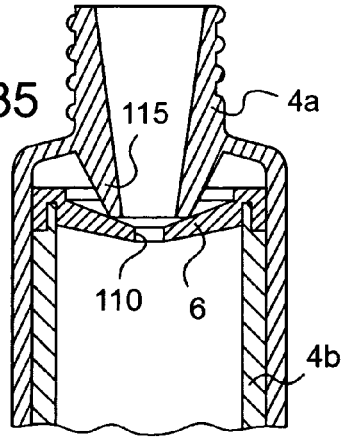
Fig.36
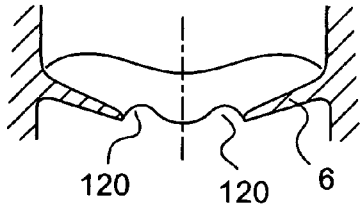

APPLICATOR FOR APPLYING A COMPOSITION TO THE EYELASHES AND/OR THE EYEBROWS

This non provisional application claims the benefit of French Application No. 05 51354 filed on May 24, 2005 and U.S. Provisional Application No. 60/688,363 filed on Jun. 8, 2005.

The present invention relates to an applicator for applying a composition to the eyelashes and/or the eyebrows.

BACKGROUND

U.S. Pat. No. 6,655,390 discloses an applicator comprising an applicator member at one end of a stem, the applicator member including a support made of plastics material and comprising two branches together defining a greatest width of the support.

Each branch carries at least one row of applicator elements that are directed towards the other branch, and that cross over the applicator elements of the other branch. In such an applicator, the combing zone defined by the intersections of the applicator elements is relatively narrow. In addition, in an embodiment, a bridge extends between the proximal and distal ends of the support, thereby making it difficult for the eyelashes to access the opening formed between the branches.

U.S. Pat. No. 6,408,857 also discloses an applicator including applicator elements that are connected to a support inserted between two branches of a mascara brush. The support is held over its entire length by the brush. The applicator elements present on the support define a relatively narrow combing zone for combing the eyelashes.

U.S. Pat. No. 5,007,442 describes an applicator comprising two stems that are hinged at one end, one of the stems carrying a mascara brush and the other a comb having applicator elements between which the brush can be engaged when the two stems of the applicator move towards each other, as occurs in particular when the applicator is inserted into a receptacle containing the composition for application. As a result of the mascara brush bearing against the comb while the composition is being taken, it is difficult for the comb to be loaded with a significant quantity of composition. The comb includes a plurality of openings between the branches carrying the applicator elements.

U.S. Pat. No. 4,446,880 describes an applicator including a deformable applicator member that deforms in response to an action exerted on a control member. In an embodiment, the applicator member comprises a plurality of deformable branches that are connected together at their ends, and that carry outwardly-directed applicator elements. The applicator member comes to bear against the stem at its proximal end, and its distal end is not free but is disposed against the head of a drive element that is movable relative to the stem, and that enables the applicator member to deform. Only one branch is provided for coming into contact with the eyelashes during application, and the combing zone is thus relatively narrow.

European patent application EP 0 875 169 discloses an applicator that comprises three fluted branches, and that is provided at one end with a foam endpiece.

SUMMARY

The invention proposes a novel applicator having a relatively large surface area for combing and impregnating the eyelashes with the composition.

In one of its aspects, the invention provides an applicator for applying a composition to the eyelashes and/or the eyebrows, the applicator comprising:

- a stem that may be the only stem; and
- an applicator member at one end of the stem, the applicator member comprising:
  - a support that is made of plastics material, and that is elongate along a longitudinal axis, the support being connected at a proximal end to the stem, and presenting a free distal end, the support comprising two branches that extend along the longitudinal axis of the support, the branches forming between them at least one opening that advantageously does not receive the bristles of a mascara brush, the opening preferably being the only opening, and the branches together defining a greatest width of the support; and
  - at least one row of applicator elements on one of the branches, the row comprising applicator elements which, over at least half of their length, extend other than over the opening.

By means of the invention, since the user has a combing and composition-loading zone that can be relatively large, the eyelashes can, for example, come into contact with at least the composition present in the opening and with an applicator element present on at least one of the branches.

In view of the fact that over at least half of their lengths, the applicator elements extend other than over the opening, it is easier for the eyelashes to access the opening and the composition contained in said opening.

As mentioned above, the opening of the applicator member may be the only opening and/or it may be substantially plane. By way of example, the opening may present substantially the same shape as the outline of the support.

The branches are preferably only two in number, and they may advantageously be connected together at their ends.

The distal and proximal ends of the support may taper, thereby making it easier to insert the applicator into a receptacle containing the composition. The distal and proximal ends need not be connected together other than via the two branches. The proximal end of the support may be rounded or beveled, in such a manner as to make it easier to withdraw the applicator.

The support may be at least 1.5 times longer than it is wide.

The applicator elements may be made of the same material as the branches, e.g. by molding plastics material. In a variant, at least a fraction of the applicator elements may be made of a material that is different from the material of the branches, the applicator elements being injection molded onto the branches, for example.

The support may be fitted onto the stem, or it may be made integrally with the stem.

The stem may be connected, at its end remote from the support, to a closure cap for closing, in leaktight manner, a receptacle containing the composition for application.

The stem may present a longitudinal axis that coincides with the longitudinal axis of the support. In a variant, the support may have a longitudinal axis that forms an angle with the longitudinal axis of the stem.

Each branch of the support may include at least one row of applicator elements.

Each of the rows may comprise applicator elements which, over at least half of their length, extend other than over the opening, or which do not extend over the opening at all.

By way of example, all of the applicator elements may extend on one side only of the support, or on two opposite sides of the support, with different configurations of the applicator elements on each side, for example. Where appropriate, this makes it possible for the user to select the side of the support that is best suited for obtaining the desired result.

The support may comprise, in an exemplary embodiment of the invention, a row of application elements on a first face of one of the branches of the support and another row of application elements on a second face, diametraly opposed to the first face, on the other branch of the support.

The application elements of these rows may for example have a side that is located in alignment with the facing faces of the support defining the opening.

In an another exemplary embodiment, each branch comprises two rows of application elements on opposite faces. These application elements may have a side extending in alignment with the facing faces of the support defining the opening.

The support may have, when observed from above, along the normal to a plane of the opening, a smooth outline, the application elements not projecting out of this outline.

The application elements may be teeth having a base having a substantially rectangular shape, with a large side being parallel or coincident with an edge of the opening.

In an embodiment, at least one of the branches may include applicator elements on its outer periphery.

Still in an embodiment, at least one of the branches may include applicator elements on two opposite faces of the support.

At least one of the branches may also include two rows of applicator elements on two different faces of the branch.

The axis of at least one row of applicator elements extending along a branch of the support may be rectilinear or curvilinear, in particular outwardly concave or convex. The axis of at least one row of applicator elements extending along a branch of the support may also be sinuous.

The support may include a first branch having an outside edge that is outwardly convex, at least in part, and a second branch having an outside edge that is concave, at least in part, or rectilinear.

In a variant, the support may also include a first branch having an outside edge that is outwardly concave, at least in part, and a second branch having an outside edge that is outwardly concave, at least in part, or rectilinear.

The support may present a longitudinal axis that coincides with the longitudinal axis of the stem, that is parallel thereto but offset, or that forms a non-zero angle relative thereto.

Each of the applicator elements of at least one row may extend in a direction that is substantially parallel to the normal to the plane of the opening, with each then being substantially completely over the corresponding branch.

At least one applicator element of at least one row extends forming a non-zero angle to the normal to the plane of the opening. In this event, the applicator element may have a portion adjacent to its free end that extends over the opening or outside the branches.

At least a plurality of consecutive applicator elements of a row may be disposed in a staggered configuration, or in some other configuration.

A plurality of consecutive applicator elements of a row may extend, at least in part, in alternation on either side of a geometrical dividing surface.

At least two applicator elements of a row may present touching or spaced-apart bases.

Two consecutive applicator elements of a row may form a V shape. For example, at least two consecutive applicator elements of a row may form between them a V-shaped groove when the applicator element is observed along a direction that is substantially perpendicular to the axis of the row, or, in a variant, that is substantially parallel to the axis of the row.

The configuration of the applicator elements could be selected as a function of the makeup effect to be achieved, e.g. made up to a heavier or lighter extent.

At least three consecutive elements of a row may optionally be evenly spaced along the axis of said row.

The applicator member may include at least a first row of applicator elements, and a second row of applicator elements, the first row comprising at least three applicator elements following one another at a first spacing, and the second row comprising at least three applicator elements following one another at a second spacing.

The first spacing may be equal to the second spacing, or it may be different therefrom.

The first and second rows may be carried by a common branch of the support, e.g. being respectively disposed on opposite faces of the branch, or they may be carried by two different branches of the support.

At least one applicator element of a row may be connected substantially perpendicularly to the corresponding branch.

At least one applicator element of a row may extend entirely other than over the opening.

At least two consecutive applicator elements of a row may cross over each other when the applicator member is observed along a direction that is substantially perpendicular to the axis of the row. The two applicator elements may advantageously form a V-shaped channel by crossing over each other, thereby making it easier to grip the eyelashes.

The applicator elements of the respective branches may be different.

At least one of the branches may include rows having different applicator elements. By way of example, one face of one of the branches may support applicator elements of a first kind, and another face may support applicator elements of another kind.

The applicator elements may present various shapes, in particular they may be elongate in shape, e.g. peg or tooth shaped, e.g. a peg shape that is cylindrical of optionally-circular section, conical, frustoconical, or pyramidal, of optionally rectilinear longitudinal axis. Applicator elements may present rounded free ends. Applicator elements may be generally flat in shape, with an elongate cross-section along a long axis that is substantially perpendicular to the longitudinal axis of the branch that carries the applicator elements, for example.

Within any one row, the applicator elements may be of different shapes and/or unevenly spaced.

By way of example, in cross-section, the applicator elements present a long transverse dimension that is greater than or equal to 0.2 millimeters (mm), better greater than or equal to 0.5 mm, e.g. in the form of different flocking bristles. For example, when the applicator elements are cylindrical pegs, their diameter can be greater than or equal to 0.2 mm.

The height of the applicator elements lies in the range 1 mm to 12 mm, for example, in particular in the range 2 mm to 8 mm, or 3 mm to 6 mm.

The support may present a shape that is generally flat.

In another of its aspects, the invention also provides a packaging and applicator device for a composition comprising makeup and/or a care product for application to the eyelashes and/or the eyebrows, the device comprising:

an applicator as defined above; and the composition for application to the eyelashes and/or the eyebrows.

The device may further comprise a receptacle containing said composition.

The receptacle may include a wiper member.

The applicator member and the wiper member may be arranged in such a manner that the applicator member deforms on passing through the wiper member. In a variant, the applicator member and the wiper member may be arranged in such a manner that the applicator member does not deform on passing through the wiper member.

In another of its aspects, the invention also provides a method of applying a composition to the eyelashes and/or the eyebrows, the method comprising:

loading the applicator member of the applicator as defined above with composition; and applying the composition to the eyelashes and/or the eyebrows.

The applicator member may be loaded with composition in such a manner that its opening may be completely filled with composition.

The stem may be subjected to vibration by means of a vibrator.

Each branch may carry at least one row of applicator elements, and the applicator elements belonging to both rows may be brought into contact with the eyelashes simultaneously, thereby making it possible to obtain a relatively large combing zone.

In another of its aspects, the invention also provides an applicator for applying a composition to the eyelashes and/or the eyebrows, the applicator comprising:

a single stem; and an applicator member at one end of the stem, the applicator member comprising:

a support that is made of plastics material, and that is elongate along a longitudinal axis, the support being connected at a proximal end to the stem, and presenting a free distal end, the support comprising two branches that extend along the longitudinal axis of the support, the branches forming between them at least one opening, and defining a greatest width of the support; and at least one row of applicator elements on one of the branches, the row comprising applicator elements which, over at least half of their length, extend other than over the opening.

BRIEF DESCRIPTION OF THE DRAWINGS

The invention can be better understood on reading the following detailed description of non-limiting embodiments thereof, and on examining the accompanying drawings, which form an integral part of the description, and in which:

FIG. 1 is a diagrammatic and fragmentary longitudinal section of an example of a packaging and applicator device made in accordance with the invention;

FIG. 2 is a plan view of the applicator member of the FIG. 1 device shown in isolation;

FIG. 3 is a fragmentary perspective view in section on III-III of FIG. 2;

FIG. 4 is a view similar to FIG. 3 of a variant embodiment of the applicator member;

FIGS. 5 to 8 are cross-sections of variant embodiments of the applicator member;

FIGS. 9 to 11 are fragmentary side views of variant embodiments of the applicator member;

FIGS. 12 to 14 are views similar to FIG. 2 showing still other embodiments of the applicator member;

FIGS. 15 to 22 are cross-sections showing other embodiments;

FIGS. 23 to 27 are plan views of applicator members constituting other variant embodiments;

FIG. 28 is a side view of an applicator member constituting another embodiment of the invention, FIG. 29 is a schematic perspective view of another example of applicator member made according to the invention, FIG. 30 is a top view along XXX of FIG. 29, FIG. 31 is a side view of the applicator member of FIG. 30, FIG. 32 is a cross section along XXXII-XXXII of FIG. 31, FIG. 33 is a detail view along XXXIII of FIG. 30, FIG. 34 is a view similar to FIG. 32 of a variant, FIG. 35 shows in a schematic manner a adjustable wiper member, and FIG. 36 shows in a schematic manner an ondulated wiper member.

MORE DETAILED DESCRIPTION

The packaging and applicator device 1 shown in FIG. 1 comprises a receptacle 2 containing a composition P for application to the eyelashes and/or the eyebrows, e.g. mascara or a care product, and an applicator 3 for taking the composition P and for applying it.

In the embodiment under consideration, the receptacle 2 comprises a body 4 provided with a neck 5 in which there is housed a wiper member 6.

The applicator 3 includes a single stem 8 that is connected at one end to a handle 9 that also constitutes a closure cap for closing the receptacle 2 in leaktight manner.

The other end of the stem 8 carries an applicator member 10 that is shown in isolation in FIG. 2.

By way of example, the wiper member 6 is adapted to wipe the stem 8 and the applicator member 10.

Depending on the shape of said applicator member, and on the material from which it is made, as well as the shape and the kind of wiper member 6, the applicator member 10 can optionally deform on passing through the wiper member 6.

By way of example, it is possible to select the wiper member 6 as a function of the quantity of composition that is desired on the applicator member 10.

In the embodiment shown, both the applicator member 10 and the wiper member 6 deform while the applicator is being withdrawn from the receptacle.

The applicator member 10 includes a support 11 that presents a generally elongate shape along a longitudinal axis X, which, in the embodiment under consideration, coincides with the longitudinal axis Y of the stem 8.

The support 11 comprises two branches 12 and 13 that are connected together at their ends by distal and proximal portions 15 and 16 of the support 11.

The branches 12 and 13 define a greatest width W of the support 11.

In the embodiment shown, both of the branches 12 and 13 extend substantially parallel to the axis X, and they co-operate with the regions 15 and 16 to define between them a completely free single opening 19, the distal and proximal ends of the support being connected together only by the branches 12 and 13.

In the embodiment under consideration, the opening 19 is plane and parallel to the plane formed by the longitudinal axes of the branches 12 and 13.

The distal region 15 of the support preferably tapers, as shown, so as to make it easier for the applicator to be returned into the receptacle. The opening 19 can present an elongate shape, as shown, with, for example, a maximum length L that is less than or equal to 35 mm, e.g. lying in the range 26 mm to 28 mm, and a maximum width l that is less than or equal to 10 mm, e.g. lying in the range 2 mm to 3 mm.

In the embodiment under consideration, the proximal portion 16 of the support 11 is connected to an endpiece 26 for fastening to the stem 8. Fastening can be performed by heat-sealing, by snap-fastening, by force-fitting, by clamping, and/or by adhesive, for example.

The proximal region 16 of the support 11 preferably tapers towards the endpiece 26, so as to make it easier for the applicator member to pass through the wiper member.

In a variant, the support 11 is made integrally with the stem 8, e.g. by molding a plastics material.

Each branch 12 or 13 includes a respective row 20 or 21 of applicator elements 23, with said applicator elements being disposed in a staggered configuration along the rectilinear axis Z of each row in the embodiment under consideration.

In order to use the device 1, the user withdraws the applicator 3 from the receptacle 2.

The opening 19 can optionally be completely filled with composition depending on the rheology of the composition P, on the kind of wiper member 6, and on the dimensions of the opening 19.

It can be advantageous for the opening 19 to be filled completely with composition P, since that can enable the eyelashes to be well loaded.

The distance between the branches 12 and 13 can be small enough for the applicator elements present on said branches to come into contact with the eyelashes simultaneously during application.

The applicator elements 23 can be disposed in many ways on the support 11, without going beyond the ambit of the present invention.

In the embodiment in FIGS. 1 to 3, the applicator elements 23 are all oriented substantially parallel to the normal N to the plane of the opening 19, and they extend on the same side of the support 11.

The applicator elements 23 are disposed in the same way, or in substantially the same way, on each of the branches 12 and 13.

FIG. 4 shows the possibility of the branches 12 and 13 including different configurations of applicator elements 23, with applicator elements that are spaced further apart on the branch 12 than on the branch 13, for example, and with applicator elements that are in alignment with one another on the branch 12, but that are disposed in a staggered configuration on the branch 13, for example. By way of example, the spacing $e_1$ along the row 21 is at least half of the spacing $e_2$ along the row 20.

FIG. 5 shows the possibility of the applicator member 10 including applicator elements on two opposite sides of the support, with applicator elements 40 on one side of the support that are longer than the applicator elements 41 on the other side of the support, for example.

In the embodiment in FIG. 6, each of the branches 12 and 13 of the support 11 carries a row of applicator elements 23 that are in alignment with one another, and that are no longer disposed in a staggered configuration as in the embodiment in FIG. 3.

In the embodiments in FIGS. 3 and 6 in particular, the applicator elements 23 are connected substantially perpendicularly to the corresponding branches.

Other configurations can also be envisaged, and the FIG. 7 embodiment shows the possibility of the support 11 carrying applicator elements 33 that slope outwards at an angle $\alpha$ to the normal N to the plane of the opening 19.

FIG. 7 also shows the possibility of each of the branches 12 and 13 of the support 11 including a second row of applicator elements 34, which can slope inwards at a non-zero angle $\beta$ to the normal N, for example. The angles $\alpha$ and $\beta$ can optionally be equal. Thus, in use, by selecting the side having the applicator elements 33, or the side having the applicator elements 34, the user can have a combing zone that is larger or smaller.

In the embodiment in FIG. 7 it can be seen that the projection of the applicator elements 33 or 34 onto the plane of the opening 19, parallel to the normal N, is situated essentially over the branches 12 or 13 and not over the opening 19. Other configurations can also be envisaged, and the applicator elements 34 could extend further inwards, for example.

In the embodiment in FIG. 8, within each row, the applicator elements 44 and 45 extend in alternation away from and towards the other branch on either side of a geometrical dividing surface.

Within any one row, the bases of the applicator elements can be substantially in alignment with one another, as in FIG. 8.

FIGS. 9 to 11 show other examples of configurations for the applicator elements within a row, when the support is observed from the side in a direction that is parallel to the plane of the opening 19, and perpendicular to the longitudinal axis X.

It can be seen in FIG. 9 that the applicator elements 23 can be successively oriented towards the distal end and towards the proximal end, in such a manner as to cross over each other when observed from the side, and thus form V-shaped channels 50.

In the embodiment in FIG. 9, the bases of the consecutive elements of the row are spaced apart along the axis Z of the row, but in the embodiment in FIG. 10, the applicator elements are grouped together in pairs, having bases that substantially occupy the same axial position along the support, the applicator elements of one pair extending towards the proximal end and towards the distal end respectively of the support, in such a manner as to form respective V-shaped channels 50 when the support is observed from the side, as in FIG. 10.

The applicator elements 23 can be of various shapes, and in particular of a shape that tapers towards their free ends. Two consecutive applicator elements can thus form between them a V-shaped channel 50, as shown in FIG. 11.

In general manner, within any one row or branch, the applicator elements can be disposed in any one of the ways disclosed in US patent applications Nos. 2002/0020424 A1, 2001/0047808 A1, and 2001/003785 A1, and in U.S. Pat. Nos. 6,581,610, 6,546,937, 6,539,950, 6,446,637, and 6,412,496.

The support can be of shape other than the shape shown in FIGS. 1 and 2, e.g. a shape in which the branches 12 and 13 are curved.

In the embodiment in FIG. 12, the opening 19 presents a width that varies, the branches 12 and 13 generally being outwardly concave.

In the embodiment in FIG. 13, the applicator elements 23 extend not only over the branches 12 and 13, but also over the distal portion 15 of the support.

FIG. 14 shows the possibility of the applicator member including applicator elements 60 that are disposed on at least a fraction of the outer periphery of the support, e.g. on the branches 12 and 13 only.

The applicator member can further include applicator elements 23 on at least one of its main faces, as shown.

FIG. 15 is a section view of an applicator member including applicator elements 60 on its periphery, and on only one of its main faces, whereas in FIG. 16, the applicator member includes applicator elements on both of its main faces.

FIGS. 17 to 22 show examples of a few additional configurations of the applicator elements on the support. On one of the branches, the applicator elements can form V shapes, whereas on the other branch the applicator elements can be upright and in alignment with one another, as shown in FIG. 17.

In the embodiment in FIG. 18, the applicator elements of the two branches are present on respective faces of the support that are opposite. By way of example, the applicator elements form V shapes within a row, when said row is observed along its axis.

In the embodiment in FIG. 19, each branch includes two rows of applicator elements on two opposite faces, with one of the rows comprising applicator elements that are upright and in alignment with one another, and the other comprising applicator elements that are V-shaped. Two rows having similar configurations of the applicator elements are connected to opposite main faces of the support.

FIG. 20 shows the possibility of making the applicator member with two branches having different shapes in cross-section.

FIG. 21 shows the possibility of having, on one face of the applicator member, applicator elements of a first kind, and on the opposite face, applicator elements of a second kind, e.g. on one face, cylindrical pegs having their longitudinal axes substantially perpendicular to the face of the support, and on the other side, applicator elements having their longitudinal axes extending obliquely relative to the corresponding face of the support, e.g. V-shaped applicator elements.

FIG. 22 shows the possibility of the branches presenting a height h, measured perpendicularly to the main faces of the support, that is greater than the width l of the cavity between the branches.

At least one of the branches can include a portion carrying applicator elements that extends with a longitudinal axis that is not rectilinear, e.g. sinuous, as shown in FIG. 23.

FIG. 24 shows the possibility of one of the branches presenting a rectilinear portion including the applicator elements, and of the other branch presenting an outwardly-concave outside edge.

The applicator member shown in FIG. 25 presents a curvilinear longitudinal axis, the free end of the applicator member possibly being in alignment with the longitudinal axis of the stem of the applicator. In the embodiment in this figure, one of the branches presents an outwardly-concave outside edge, and the other branch presents a convex outside edge.

FIG. 26 shows the possibility of one of the branches being substantially rectilinear, and of the other branch presenting an outwardly-convex outside edge.

FIG. 27 shows the possibility of the applicator member presenting a longitudinal axis X that is parallel to the longitudinal axis Y of the stem of the applicator, but that is offset relative thereto.

FIG. 28 shows the possibility of the longitudinal axis X of the applicator member forming a non-zero angle $\gamma$ with the longitudinal axis Y of the stem, the axes X and Y being coplanar and contained in a plane that is substantially perpendicular to the main faces of the applicator member 10, for example.

FIGS. 29 to 33 show another example of applicator member 30. In this embodiment, the branch 12 carries a unique row of application elements 23 which are teeth, these teeth connecting to a face 100 of the branch 12. The face 100 is oriented generally perpendicularly to the normal N of the plane of the opening 19.

The branch 13 comprises also a row of application elements 23 which extend on a face 101 that is located diametrically at the opposite of face 100 of the branch 12. The face 101 extends generally perpendicularly to the normal N.

In the present embodiment, the application elements 23 extend in alignment with the internal facing faces of branches 12 and 13, which are generally parallel to the normal N.

The proximal portion 16 of the applicator member 10 connects via a shoulder 105 to the end piece 26, the width of this shoulder 105 corresponding substantially to the thickness of the wall of the stem that defines the housing receiving the endpiece 26.

One may see in this embodiment that the opposite external faces 106 of the branches 12 and 13 are smooth and deprived of application elements.

The faces 106 may be generally plane or may have a curved profile which is convex towards the outside.

The total length M along the longitudinal axis X along which a row of application elements 23 extend may for example be greater or equal to 20 mm.

The application elements may have a tooth shape that is tapering towards a free end 126, with a base having a large side that is coincident with or that extends parallel to the edge 125 defining the opening 119, when the applicator member is seen from above.

In the variant embodiment of FIG. 34, each branch 12 or 13 comprises a second row of application elements, opposed to the first row, on opposed faces 112, respectively 113. The applicator member has a shape that is symmetric relative to a plane that is perpendicular to the normal N.

Whatever the applicator member that is used, the associated wiper member 6 may be placed in a receptacle having a body comprising two parts 4*a* and 4*b* that are movable one relative to the other, so as to vary a diameter of the opening 110 of the wiper member 6, as shown on FIG. 35.

In the embodiment of FIG. 35, the deformation of the wiper member is obtained via a projection 115 of the neck of the receptacle but the invention is not restricted to a particular arrangement of the wiper member nor to a particular manner to have the section for the passage of the applicator member vary and/or to a particular manner to adjust its deformability.

FIG. 36 shows the possibility for the wiper member 6 to comprise an ondulated a wiper lip which may unfold when the applicator member passes therethrough. The ondulations 120 are for example alternatively in hollow and in projection along the circonferiential direction.

The characteristics of the various embodiments could be combined with one another in embodiments not shown.

In a variant, the composition could be in the form of a cake, or it could be contained in a tube.

The wiper member could be different, and could be in the form of a block of foam.

The support could be made of a relatively rigid or flexible plastics material. In particular, the support could be made entirely of a rigid plastics material, of an elastomer material, of polyethylene terephthalate (PET), polyoxymethylene (POM), polyamide (PA), polystyrene (PS), polypropylene (PP), or polyethylene (PE), or it could be made of silicone, nitrile, ethylene-propylene terpolymer rubber (EPDM), ethyl vinyl acetate (EVA), polyvinyl chloride (PVC), polyurethane (PU), latex, or butyl, or of thermoplastic elastomers such as HYTREL®, PEBAX®, or SANTOPRENE®.

The length of the applicator elements of a row could lie in the range about 1 mm to about 8 mm, better in the range 2 mm to 6 mm.

The applicator elements could present various shapes, e.g. cylindrical, conical, frustoconical, or generally-flat peg shapes.

The applicator elements could be made of the same material as the support, or, in a variant, they could be made by injection molding a different material onto the support.

The applicator elements could present magnetic properties, e.g. they could include magnetic particles.

The stem of the applicator could be subjected to vibration, e.g. as a result of the presence, within the handle, of a vibrator, e.g. similar to vibrators that are to be found in mobile telephones.

In all embodiments, the applicator member may be at least partially flocked or not.

The expression "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An applicator for applying a composition to at least one of eyelashes and eyebrows, the applicator comprising:

a stem; and an applicator member at one end of the stem, the applicator member comprising:

a support that comprises plastics material, and that is elongate along a longitudinal axis, the support being connected at a proximal end to the stem, the support comprising only two branches that extend along the longitudinal axis of the support, the only two branches connected to one another to define a free distal end of the applicator member and a single through-opening between the only two branches, and the only two branches together defining a greatest width of the support; and at least one row of applicator elements on one of the only two branches, the row comprising applicator elements which, over at least half of their length, extend other than over the opening.

2. An applicator according to claim 1, wherein the through-opening is substantially planar.

3. An applicator according to claim 1, wherein the through-opening is substantially a same shape as an outline of the support.

4. An applicator according to claim 1, wherein at least one of the distal end and the proximal end of the support is tapered.

5. An applicator according to claim 1, wherein the support is at least 1.5 times longer than wide.

6. An applicator according to claim 1, wherein the applicator elements comprise a same material as the only two branches.

7. An applicator according to claim 1, wherein at least a fraction of the applicator elements comprises a material that is different from a material of the only two branches.

8. An applicator according to claim 1, wherein the support is fitted onto the stem.

9. An applicator according to claim 1, wherein the support is monolithic with the stem.

10. An applicator according to claim 1, wherein the stem is connected, at an end remote from the support, to a closure cap configured to close in a leaktight manner, a receptacle containing the composition for application.

11. An applicator according to claim 1, wherein the stem includes a longitudinal axis that coincides with the longitudinal axis of the support.

12. An applicator according to claim 1, wherein each branch of the support includes at least one row of applicator elements.

13. An applicator according to claim 12, wherein each of the rows comprises applicator elements which, over at least half of their length, extend other than over the through-opening.

14. An applicator according to claim 12, wherein all of the applicator elements extend on one side only of the support.

15. An applicator according to claim 12, wherein the applicator elements extend on two opposite sides of the support.

16. An applicator according to claim 1, wherein at least one branch includes at least two rows of applicator elements that extend on respective opposite faces of the support.

17. An applicator according to claim 1, wherein a maximum length of the through-opening is not greater than 35 mm.

18. An applicator according to claim 1, wherein a maximum width of the through-opening is not greater than 10 mm.

19. An applicator according to claim 1, wherein an entirety of the support comprises a rigid plastics material.

20. An applicator according to claim 1, wherein an entirety of the support comprises at least one of an elastomer and a flexible material.

21. An applicator according to claim 1, wherein the support comprises at least one of PET, POM, PA, PS, PP, and PE.

22. An applicator according to claim 1, wherein the support comprises at least one of silicone, nitrile, EPDM, EVA, PVC, PU, latex, butyl, and a thermoplastic elastomer.

23. An applicator according to claim 1, wherein an axis of at least one row of applicator elements extending along a branch of the support is rectilinear.

24. An applicator according to claim 1, wherein an axis of at least one row of applicator elements extending along a branch of the support is curvilinear.

25. An applicator according to claim 1, wherein an axis of at least one row of applicator elements extending along a branch of the support is sinuous.

26. An applicator according to claim 2, wherein each of the applicator elements of at least one row extends in a direction that is substantially parallel to a normal to a plane of the through-opening.

27. An applicator according to claim 1, wherein the applicator elements of the respective branches are different.

28. An applicator according to claim 1, wherein at least one of the branches includes rows including respective different applicator elements.

29. An applicator according to claim 2, wherein at least one applicator element of at least one row extends forming a non-zero angle to a normal to a plane of the through-opening.

30. An applicator according to claim 1, wherein at least a plurality of consecutive applicator elements of a row are disposed in a staggered configuration.

31. An applicator according to claim 1, wherein two consecutive applicator elements of a row form a V shape.

32. An applicator according to claim 1, wherein a plurality of consecutive applicator elements of a row extend, at least in part, in alternation on either side of a geometrical dividing surface.

33. An applicator according to claim 1, wherein at least two applicator elements of a row include touching bases.

34. An applicator according to claim 1, wherein at least two consecutive applicator elements of a row include spaced-apart bases.

35. An applicator according to claim 1, wherein at least two consecutive applicator elements of a row form a V-shaped groove therebetween when the applicator element is observed along a direction that is substantially perpendicular to an axis of the row.

36. An applicator according to claim 1, wherein at least three consecutive elements of a row are evenly spaced along an axis of said row.

37. An applicator according to claim 1, wherein at least three consecutive elements of a row are unevenly spaced along an axis of said row.

38. An applicator according to claim 1, wherein the applicator member includes at least a first row of applicator elements, and a second row of applicator elements, the first row comprising at least three applicator elements following one another at a first spacing, and the second row comprising at least three applicator elements following one another at a second spacing.

39. An applicator according to claim 38, wherein the first spacing is equal to the second spacing.

40. An applicator according to claim 38, wherein the first spacing is different from the second spacing.

41. An applicator according to claim 38, wherein the first and second rows are carried by a common branch of the support, being respectively disposed on opposite faces of the branch.

42. An applicator according to claim 38, wherein the first and second rows are carried by two different branches of the support.

43. An applicator according to claim 1, wherein at least one applicator element of a row is connected substantially perpendicularly to the corresponding branch.

44. An applicator according to claim 1, wherein at least one applicator element of a row extends entirely other than over the through-opening.

45. An applicator according to claim 1, wherein a length of the applicator elements of a row lies in a range of about 1 mm to about 10 mm.

46. An applicator according to claim 1, wherein at least two consecutive applicator elements of a row cross over each other when the applicator member is observed along a direction that is substantially perpendicular to an axis of the row.

47. An applicator according to claim 1, wherein at least one of the only two branches includes applicator elements on an outer periphery thereof.

48. An applicator according to claim 1, wherein at least one of the only two branches includes applicator elements on two opposite faces of the support.

49. An applicator according to claim 1, wherein at least one of the only two branches includes two rows of applicator elements on two different faces of the branch.

50. An applicator according to claim 1, wherein at least one of the only two branches includes three rows of applicator elements.

51. An applicator according to claim 1, wherein at least one of the support and the applicator elements include magnetic particles.

52. An applicator according to claim 1, wherein the applicator member includes an outline that is smooth when the applicator member is observed along to a normal to a plane of the through-opening.

53. An applicator according to claim 1, wherein a length of the applicator member is over 20 mm.

54. A packaging and applicator device for a composition comprising at least one of makeup and a care product for application to at least one of eyelashes and eyebrows, the device comprising: an applicator as defined in claim 1; and a composition configured to be applied to at least one of eyelashes and eyebrows.

55. A device according to claim 54, further comprising a receptacle containing said composition.

56. A device according to claim 55, wherein the receptacle includes a wiper member.

57. A device according to claim 56, wherein the applicator member and the wiper member are configured such that the applicator member deforms on passing through the wiper member.

58. A device according to claim 56, wherein the applicator member and the wiper member are configured such that the applicator member does not deform on passing through the wiper member.

59. A method of applying a composition to at least one of eyelashes and eyebrows, the method comprising: loading the applicator member of the applicator as defined in claim 1 with composition; and applying the composition to at least one of eyelashes and eyebrows.

60. A method according to claim 59, wherein the applicator member is loaded with composition such that the through-opening is completely filed with composition.

61. A method according to claim 59, wherein the applicator member is loaded with composition without the through-opening being completely filled with composition.

62. A method according to claim 60, wherein each branch of the only two branches carries at least one row of applicator elements, and wherein the applicator elements belonging to both rows are brought into contact with the eyelashes simultaneously.

63. A method according to claim 59, wherein the stem is subjected to vibration.

* * * * *